US011828154B2

(12) United States Patent
Alrabaei et al.

(10) Patent No.: US 11,828,154 B2
(45) Date of Patent: Nov. 28, 2023

(54) DOWN-HOLE SEPARATOR FOR IN-SITU GAS-LIFT

(71) Applicant: SAUDI ARABIAN OIL COMPANY, Dhahran (SA)

(72) Inventors: Rayan A. Alrabaei, Jeddah (SA); Musa Alnafisah, Dhahran (SA); Mohammed Noui-Mehidi, Dhahran (SA); Mohammed H. Alkhaldi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 2 days.

(21) Appl. No.: 17/647,782

(22) Filed: Jan. 12, 2022

(65) Prior Publication Data

US 2023/0220759 A1 Jul. 13, 2023

(51) Int. Cl.

| | |
|---|---|
| ***E21B 43/38*** | (2006.01) |
| ***B04C 5/15*** | (2006.01) |
| ***E21B 43/40*** | (2006.01) |
| ***E21B 43/12*** | (2006.01) |

(52) U.S. Cl.

CPC ..... *E21B 43/38* (2013.01); *B04C 5/15* (2013.01); *E21B 43/122* (2013.01); *E21B 43/40* (2013.01)

(58) Field of Classification Search

CPC ..... E21B 43/40; E21B 43/12; E21B 43/121; E21B 43/123; E21B 43/122; E21B 43/34; E21B 43/38

See application file for complete search history.

(56) References Cited

U.S. PATENT DOCUMENTS

| | | | | |
|---|---|---|---|---|
| 4,708,595 | A | 11/1987 | Maloney et al. | |
| 6,336,504 | B1 | 1/2002 | Alhanati et al. | |
| 6,494,258 | B1 | 12/2002 | Weingarten | |
| 6,672,387 | B2 | 1/2004 | Brady et al. | |
| 10,260,324 | B2 | 4/2019 | Muraikhi et al. | |
| 2002/0174982 | A1* | 11/2002 | Weingarten | E21B 43/38 166/69 |
| 2016/0265333 | A1* | 9/2016 | Roth | E21B 43/38 |
| 2022/0403728 | A1* | 12/2022 | Ellithorp | E21B 43/38 |

FOREIGN PATENT DOCUMENTS

| | | | |
|---|---|---|---|
| CN | 109057755 | A | 12/2018 |
| CN | 112360425 | A | 2/2021 |
| CN | 113187460 | A | 7/2021 |

* cited by examiner

*Primary Examiner* — Tara Schimpf
*Assistant Examiner* — Yanick A Akaragwe
(74) *Attorney, Agent, or Firm* — Osha Bergman Watanabe & Burton LLP

(57) ABSTRACT

A system includes a cyclonic separator that separates a first production fluid into a lighter phase and a heavier phase and a pipe that transports the lighter phase from a first exit of the cyclonic separator to an annulus. The pipe includes an inlet fluidly connected to the cyclonic separator, a first outlet fluidly connected to the annulus, and a second outlet fluidly connected to the annulus. The system also includes a low pressure recombination zone that reintroduces the lighter phase to the heavier phase, thereby forming a second production fluid. The low pressure recombination zone transports the second production fluid to a well exit.

15 Claims, 4 Drawing Sheets

DOWN-HOLE SEPARATOR FOR IN-SITU GAS-LIFT

BACKGROUND

Porous rock formations contain hydrocarbon reservoirs below the surface of the earth. Hydrocarbon fluids may often be found within these hydrocarbon reservoirs. These hydrocarbon fluids are then extracted from the hydrocarbon reservoirs by production wells that are drilled into the hydrocarbon reservoirs. The pressure within a hydrocarbon reservoir is often high, allowing the hydrocarbon fluids to travel naturally to the surface through the production wells. If the pressure is naturally low or the hydrocarbon reservoir is depleted, hydrocarbon fluids may still be retrieved by forms of artificial lift, such as gas lift.

Gas-lift is a common method of artificial lift for reviving dead wells and sustaining oil production. By injecting high-pressure gas from a casing annulus into fluids that have entered the production piping from the formation, gas-lift systems assist or increase production. Specifically, the injected gas lowers the fluid density and, therefore, the hydrostatic pressure of the fluid, permitting in-situ reservoir pressure to lift the lightened liquids.

However, gas-lifts are only temporary solutions to extracting hydrocarbon fluids, and often result in high energy operating costs. Further, in the case of high water-cut percentage, oil production cannot be sustained without the use of down-hole Electric Submersible Pumps (ESPs). However, ESPs have their drawbacks. In particular, ESPs operate at high voltages and their cables may deteriorate at the high temperatures seen down-hole or cause issues in handling tubulars. Finally, the unit remains down-hole during operation, leading to greater downtime when issues are met due to the difficulty in retrieving ESPs.

SUMMARY

This summary is provided to introduce concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a system for utilizing down-hole separation as a tool of in-situ gas-lift. A system includes a cyclonic separator that separates a first production fluid into a lighter phase and a heavier phase and a pipe that transports the lighter phase from a first exit of the cyclonic separator to an annulus. The pipe includes an inlet fluidly connected to the cyclonic separator, a first outlet fluidly connected to the annulus, and a second outlet fluidly connected to the annulus. The system also includes a low pressure recombination zone that reintroduces the lighter phase to the heavier phase, thereby forming a second production fluid. The low pressure recombination zone transports the second production fluid to a well exit.

In general, in one aspect, embodiments disclosed herein relate to a method for of utilizing down-hole separation as a tool of in-situ gas-lift includes separating, by a cyclonic separator, a first production fluid into a lighter phase and a heavier phase, and transporting, by a pipe, the lighter phase from an inlet fluidly connected to the cyclonic separator to a first outlet and a second outlet connected to an annulus. The method also includes reintroducing the lighter phase to the heavier phase in a main inner pipe, thereby producing a second production fluid, and transporting, by a low pressure recombination zone, the second production fluid to a well exit.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
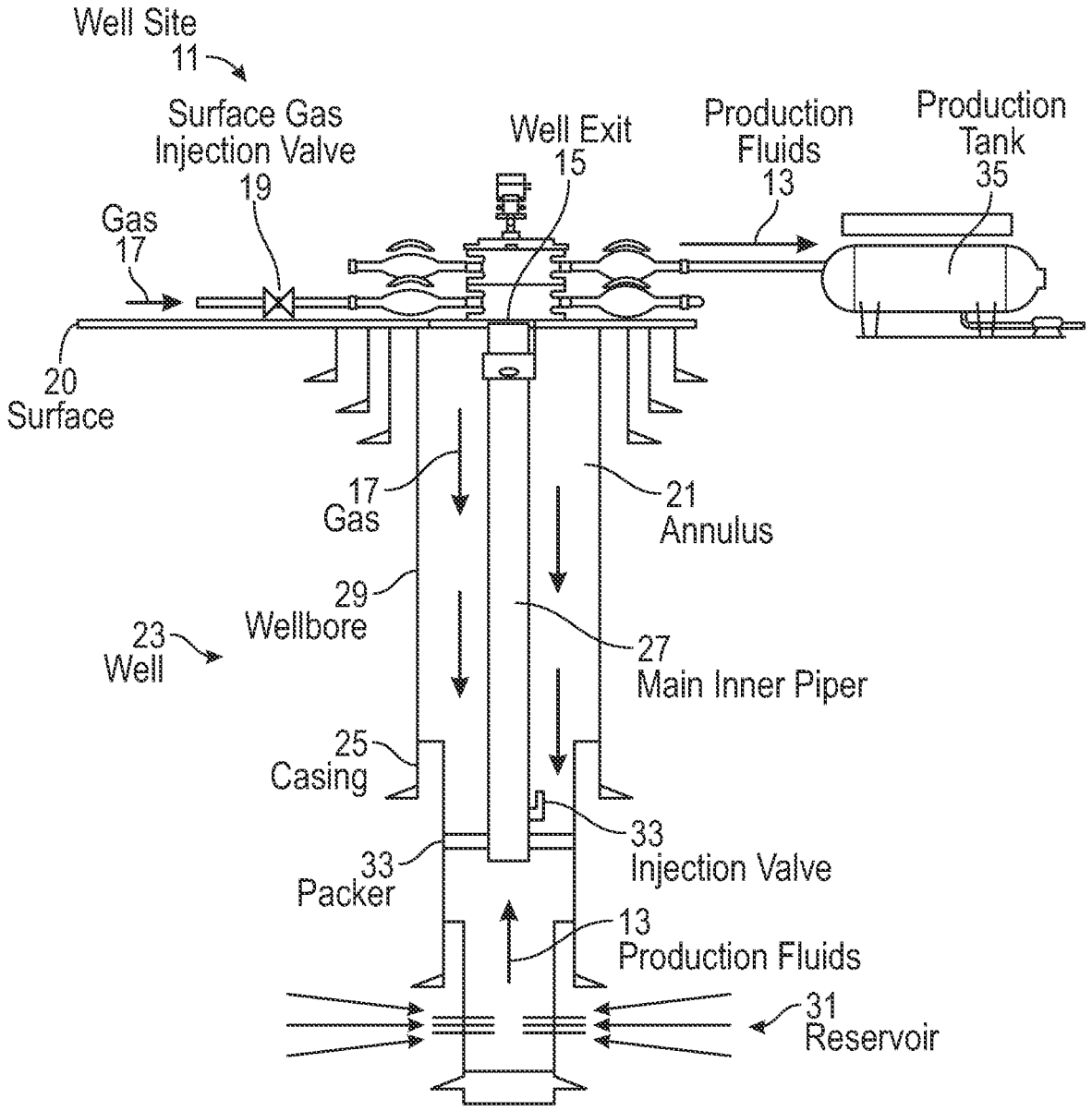
FIG. 1 shows a gas-lift well site in accordance with one or more embodiments of the present disclosure.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a down-hole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems for and methods of utilizing down-hole separation as a tool of in-situ gas-lift. The technique discussed in this disclosure is beneficial to revive dead wells and sustain hydrocarbon production.

Gas-lift systems aid or increase production by injecting high-pressure gas, from the surface, down a casing annulus into fluids disposed in the production piping. The fluid density and hydrostatic pressure of the fluid are reduced by the introduction of the injected gas, thereby allowing the in-situ reservoir pressure to lift the lightened fluids.

In-situ gas-lifts utilize gas from a reservoir gas cap or gas-bearing formations. This gas is produced down-hole and bled into the production tubing at a controlled rate by an auto gas-lift valve. The auto gas-lift valve can be controlled at the surface by hydraulic or electric means. In-situ gas-lift systems eliminate certain equipment requirements, such as gas-compression facilities, thereby saving capital.

Specifically, this disclosure describes a cyclonic separator disposed down-hole of a gas-lift well site. The cyclonic separator is situated in a main inner pipe towards the down-hole end of a wellbore. In general, the cyclonic separator is formed from two portions: a conical base and an upper portion. The conical base includes a wall, an upper exit, and a lower exit. The upper portion includes a pipe with a plurality of branches. The cyclonic separator may be formed from steel, tempered steel, copper, or equivalent. Further, the cyclonic separator uses centrifugal force to separate a first production fluid into a lighter phase and a heavier phase by creating a central vortex inside the conical base of cyclonic separator. In order to achieve this, the first production fluid flows from the reservoir into the cyclonic separator through an entrance opening in the cyclonic separator. In typical embodiments, the lighter phase is mainly gas and the heavier phase is mainly oil.

The lighter phase flows from the cyclonic separator to an annulus of the well through a pipe that is configured to transport fluid from the upper exit of the cyclonic separator to an isolated portion of the annulus. Packers, disposed in the annulus, are configured to isolate the portion of the annulus from a lower portion of the annulus, disposed adjacent to the entrance opening of the cyclonic separator, containing the first production fluid. The pipe is located above the cyclonic separator and includes multiple branches and a junction conjoining the branches, and similar to the cyclonic separator, the pipe may be formed from steel, tempered steel, copper, or equivalent. A first branch of the pipe is fluidly connected to the cyclonic separator, and the additional branches are fluidly connected to the annulus. The pipe is configured to have angles between the first branch and the additional branches that are between 90 and 180 degrees.

In tandem with the lighter phase exiting the cyclonic separator, the heavier phase flows from the lower exit of the cyclonic separator into the main inner pipe. The main inner pipe is a conduit for production fluids and is disposed in the wellbore, extending from the well exit to a depth above the reservoir. After entering the main inner pipe, the heavier phase travels upwards in the main inner pipe towards a low pressure recombination zone in the main inner pipe, adjacent to the openings in the annulus. The low pressure recombination zone is produced by the lighter phase exiting the annulus through the openings and being reintroduced to the heavier phase disposed in the main inner pipe, thereby creating a zone of low pressure. The lighter phase acts as a gas-lifting mechanism during the reintroduction by lightening the fluid column.

As a result of the reintroduction of the lighter phase to the heavier phase, a second production fluid is formed in the main inner pipe at the low pressure recombination zone, and the specific gravity of the fluid column is reduced. The second production fluid is then lifted towards the well exit by the help of the low pressure recombination zone, as the lighter phase is used as a carrier fluid to ensure a lift effect of enough measure.

FIG. 1 depicts a conventional gas-lift well site 11. Gas-lift systems "lift" production fluids 13, such as oil, gas, and/or water, to the well exit 15 by lowering the density of the production fluids 13 with a source of high pressure gas 17. The gas 17, commonly nitrogen, is supplied through a surface gas injection valve 19. The surface gas injection valve 19, disposed at the surface 20 and connected to an annulus 21 of the well 23, controls the flow of the gas 17 and injects the gas 17 at a high injection pressure into the annulus 21. The annulus 21 consists of the space between the casing 25 and the main inner pipe 27 and is configured to isolate the gas 17, allowing the gas 17 to flow the depth of the well 23 without mixing with other fluids.

The casing 25, disposed in the well 23 against the wellbore 29 and typically formed of a durable material such as steel, extends to a depth above the reservoir 31. The casing 25 isolates the subsurface fluids and supports the wellbore 29, the drilled hole comprising the well 23, up to the depth above the reservoir 31. At the other end, the wellbore 29 extends through the reservoir 31 beneath the casing 25. The reservoir 31 is disposed deep below the surface 20 of the earth in porous rock formations, and is the source of the production fluids 13.

A main inner pipe 27, disposed in the wellbore 29 and formed of tempered steel or equivalent, extends from the well exit 15 to a depth above the reservoir 31 and is a conduit for production fluids 13 to exit the well. For the embodiment depicted in FIG. 1, the production fluids 13 are oil. The oil flows from the reservoir 31 into the wellbore 29, through the casing 25, and into the main inner pipe 27. If the reservoir 31 has enough pressure, the oil travels upwards in the main inner pipe 27 to the surface 20. Conversely, if the reservoir 31 does not have enough pressure to lift the oil by itself, gas 17 is injected into the oil.

At a high pressure, the gas 17 enters the main inner pipe 27 through an injection valve 33 down-hole and mixes with the production fluids 13 disposed in the main inner pipe 27. The injection valve 33 fluidly connects the annulus 21 to the main inner pipe 27 and is configured to allow the flow of the gas 17 from the annulus 21 into the main inner pipe 27. The injection valve 33 is composed of stainless steel or the equivalent. The injection pressure, combined with the lighter weight of the gas 17, lowers the density of the production fluids 13 until the mixture becomes light enough to flow towards the well exit 15 and into a production tank 35. The production tank 35 is a storage tank, disposed at the surface 20, that collects and stores the production fluids 13 after the production fluids 13 exits the well 23.

Figure 2:
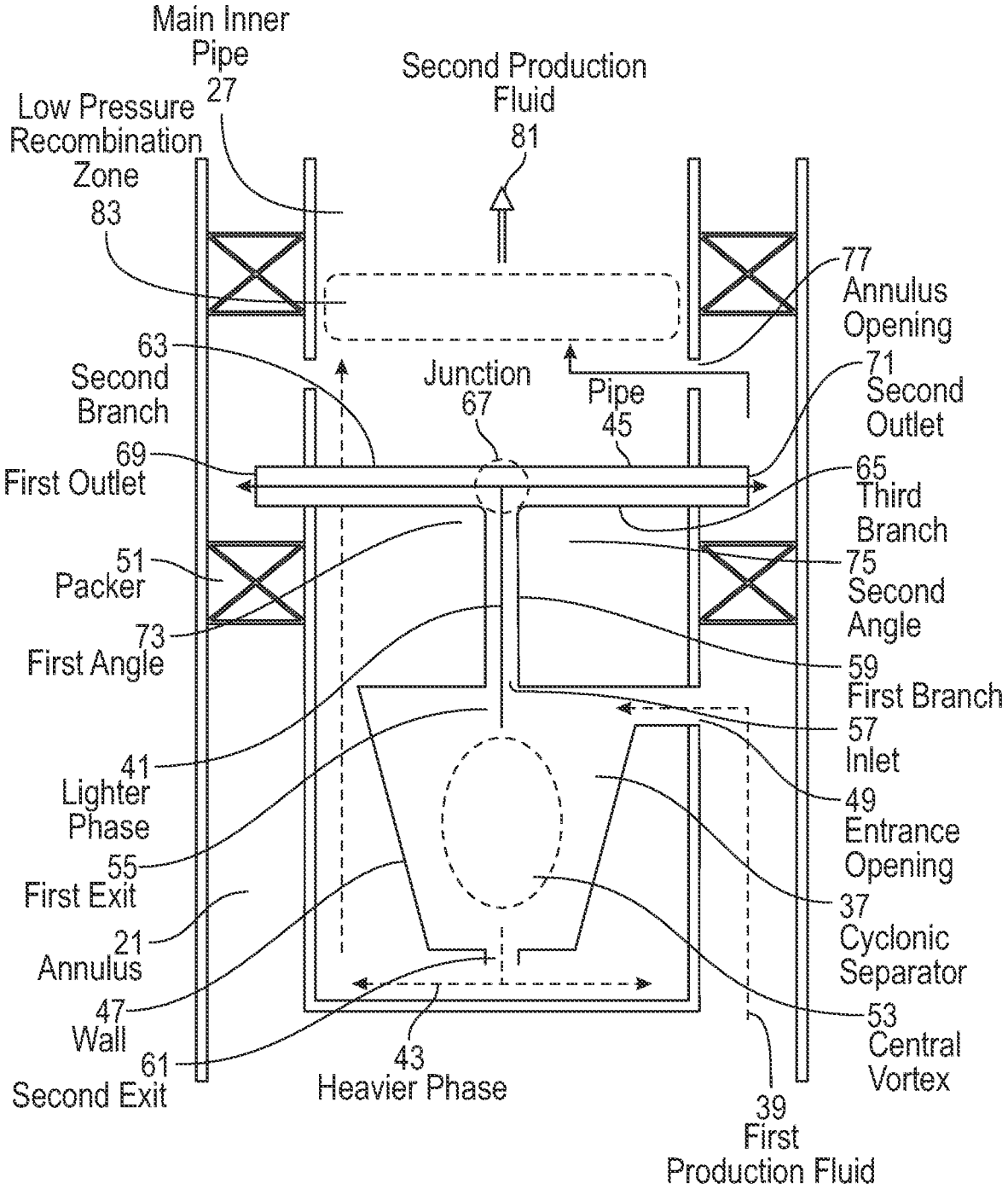
FIG. 2 shows an illustration of a down-hole separator apparatus for in-situ gas-lift in accordance with one or more embodiments of the present disclosure.
Figure 3:
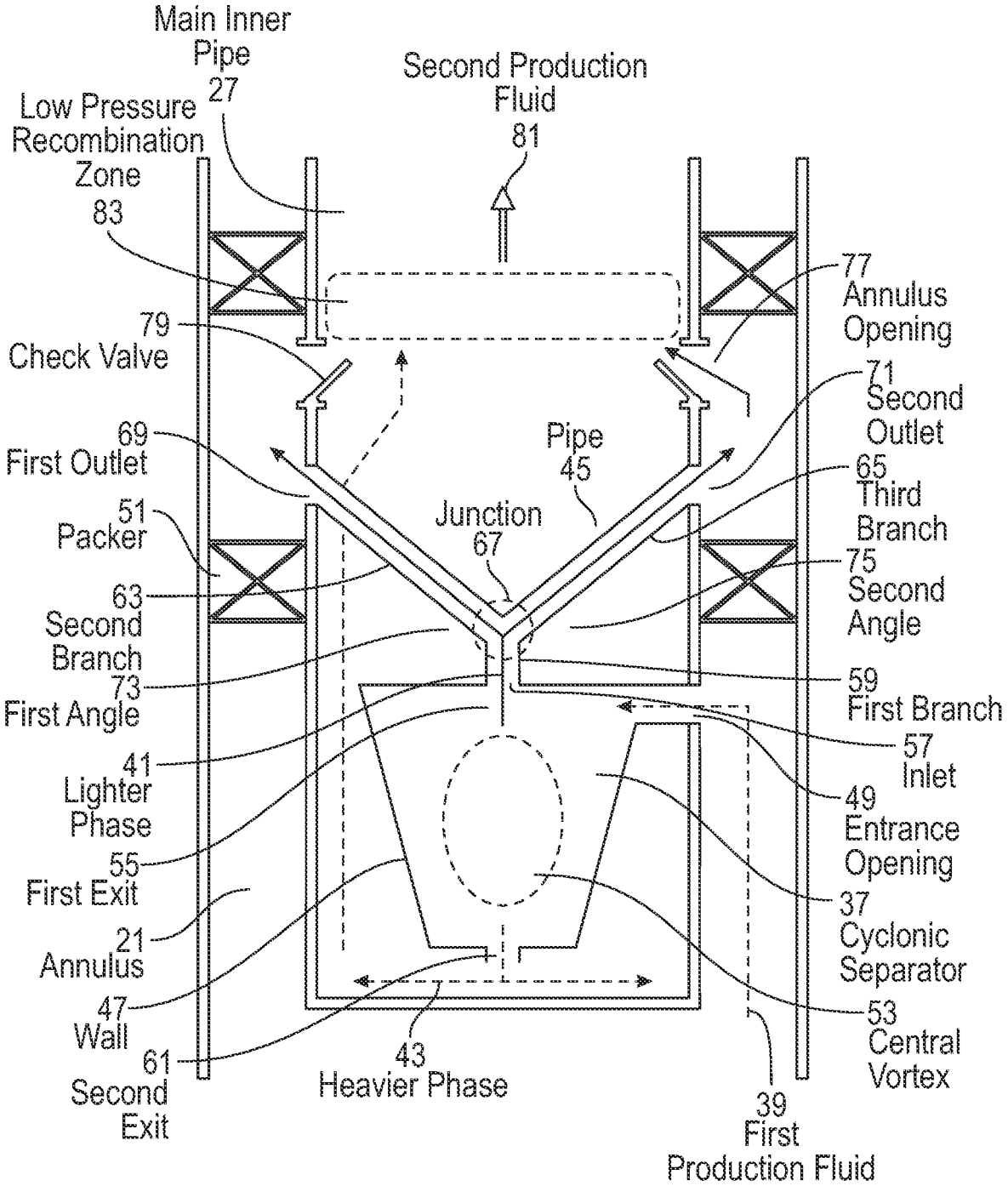
FIG. 3 shows an illustration of a second embodiment of a down-hole separator apparatus for in-situ gas-lift in accordance with one or more embodiments of the present disclosure.

FIGS. 2 and 3 depict separate possible embodiments of a down-hole separation system. The down-hole separation system consists of a cyclonic separator 37, configured to separate a first production fluid 39 into a lighter phase 41 and a heavier phase 43, disposed down-hole in the main inner pipe 27. The cyclonic separator 37 includes an upper portion with a pipe 45 including a plurality of branches, and a conical base portion delimited by a wall 47, an upper exit, and a lower exit. The cyclonic separator 37 may be formed from steel, tempered steel, copper, or equivalent.

Typically, the cyclonic separator 37 is installed and connected to the annulus 21 in the early design of the down-hole completion before installation of the well 23 equipment. The cyclonic separator 37 and the annulus 21 are connected both by a pipe 45 at an upper axial end of the cyclonic separator 37, and by an entrance opening 49 commonly disposed on the wall 47 of the cyclonic separator 37. The entrance opening 49 allows the cyclonic separator 37 to receive the first production fluid 39 from a lower portion of the annulus 21.

Packers 51 are disposed in the annulus 21 to isolate and separate portions of the annulus 21. The packers 51 are made of elastomeric materials and act as seals, preventing any fluid from passing through them. In the lower portion of the annulus 21, adjacent with the conical base of the cyclonic separator 37, packers 51 force the first production fluid 39, disposed in the annulus 21, to enter the cyclonic separator 37 through the entrance opening 49 by blocking alternative routes for the first production fluid 39 to travel. In another portion of the annulus 21, adjacent with the upper portion of the cyclonic separator 37, the packers 51 isolate the annulus 21 such that the isolated section of the annulus 21 contains the separated lighter phase 41, alone.

The first production fluid 39 is lifted and transported from the lower portion of the annulus 21 through the entrance opening 49 of the cyclonic separator 37 by the pressure of the well 23. If the pressure of the well 23 decreases or is unable to lift the first production fluid 39, the pressure at the well exit 15 can be manipulated or lowered at the surface 20 to compensate for the pressure decrease. However, the pressure of the well 23 is deliberately controlled according to targeted initial and final pressures that ensure separation and production based on calculations and is carried out by the surface gas injection valve 19 at the surface 20.

The cyclonic separator 37 is not powered. Gravity and the geometry of the cyclonic separator 37 produce centrifugal force to create a central vortex 53 within the cyclonic separator 37. Specifically, the centrifugal force separates the first production fluid 39 displaced in the cyclonic separator 37 into a lighter phase 41 and a heavier phase 43 due to density differences between the lighter phase 41 and the heavier phase 43. In typical embodiments, the lighter phase 41 is mainly gas and the heavier phase 43 is mainly oil.

The cyclonic separator 37 has a first exit 55 disposed in the upper axial end of the cyclonic separator 37. The first exit 55 is fluidly connected to an inlet 57 of a first branch 59 of the pipe 45. Further, the first exit 55 of the cyclonic separator 37 is configured to allow the lighter phase 41 to exit the cyclonic separator 37 and enter the inlet 57 of the first branch 59 of the pipe 45. The inlet 57 is configured to receive the lighter phase 41 from the first exit 55 of the cyclonic separator 37. A second exit 61 of the cyclonic separator 37 is disposed at the lower axial end of the cyclonic separator 37. The second exit 61 of the cyclonic separator 37 is configured to facilitate the heavier phase 43 exiting the cyclonic separator 37 and entering the main inner pipe 27.

The pipe 45 is disposed in the main inner pipe 27 at the upper portion of the cyclonic separator 37, and fluidly connects the cyclonic separator 37 to the annulus 21. Further, the pipe 45 is typically composed of steel, comprising of a first branch 59, a second branch 63, a third branch 65, and a junction 67 fluidly interconnecting the branches together. The pipe 45 and the plurality of branches are configured to transport the lighter phase 41 from the cyclonic separator 37 to the annulus 21.

The first branch 59 extends vertically from the first exit 55 of the cyclonic separator 37 and is connected to additional branches of the pipe 45 at the junction 67. Specifically, the junction 67 is configured to conjoin the plurality of branches of the pipe 45 and allows the lighter phase 41 to enter the additional branches from the first branch 59. The second branch 63 and third branch 65 are connected to the junction 67 and a first outlet 69 and a second outlet 71 of the pipe 45, respectively. The outlets 69, 71 of the pipe 45 are fluidly connected to the annulus 21 and are configured to allow the lighter phase 41 to exit the pipe 45 and enter the isolated portion of the annulus 21. Other embodiments of the pipe 45 may have additional branches, and, thus, the number of branches is not intended to be a limiting factor thereof.

For the embodiment depicted in FIG. 2, the pipe 45 is T-shaped. Specifically, both of a first angle 73 between the first branch 59 and the second branch 63, and a second angle 75 between the first branch 59 and the third branch 65 are 90 degrees, with a +/−5 degree tolerance. The angles 73, 75 are configured such that the second branch 63 is disposed perpendicular to the first branch 59, and allows the second branch 63 to connect to the isolated region of the annulus 21. The isolated region of the annulus 21 has openings 77 displaced between the branches of the pipe 45 and the upper packer 51, configured to act as mandrels to lighten the fluid column, leading to the main inner pipe 27.

For the embodiment depicted in FIG. 3, the pipe 45 is Y-shaped. As such, the angles 73, 75 are 120 degrees between the first branch 59 of the pipe 45 and the second branch 63 and third branch 65 of the pipe 45, with a +/−5 degree tolerance. Thus, the second branch 63 and third branch 65 of the pipe 45 are also connected to the isolated region of the annulus 21 at an angle supplementary to the angles 73, 75 of the first branch 59.

Continuing with FIG. 3, disposed at the openings 77 in the annulus 21 are check valves 79. The check valves 79 vent the lighter phase 41 from the annulus 21 into the main inner pipe 27. The check valves 79, formed of steel, prevent the heavier phase 43 disposed in the main inner pipe 27 from entering the annulus 21. Additional embodiments may include check valves 79 disposed at the entrance opening 49 of the cyclonic separator 37 to prevent the separated phases from exiting the cyclonic separator 37 through the entrance opening 49.

The lighter phase 41 is reintroduced to the heavier phase 43 subsequent to passing through the openings 77 in the annulus 21 into the main inner pipe 27, forming a second production fluid 81. The second production fluid 81 is formed in the main inner pipe 27 above the cyclonic separator 37 at a low pressure recombination zone 83. The low pressure recombination zone 83 is a zone of low pressure formed by the openings 77 in the annulus 21 by reintroducing the lighter phase 41 to the heavier phase 43 disposed in the main inner pipe 27. Further, the low pressure recombination zone 83 is configured to lift the second production fluid 81 upwards in the main inner pipe 27 towards the well exit 15 by the reintroduction of the lighter phase 41 acting as a carrier fluid to produce a lift effect. The diameter of the openings 77 in the annulus 21 may be adjusted to increase the fluid velocity and further decrease the pressure for fluid displacement.

Figure 4:
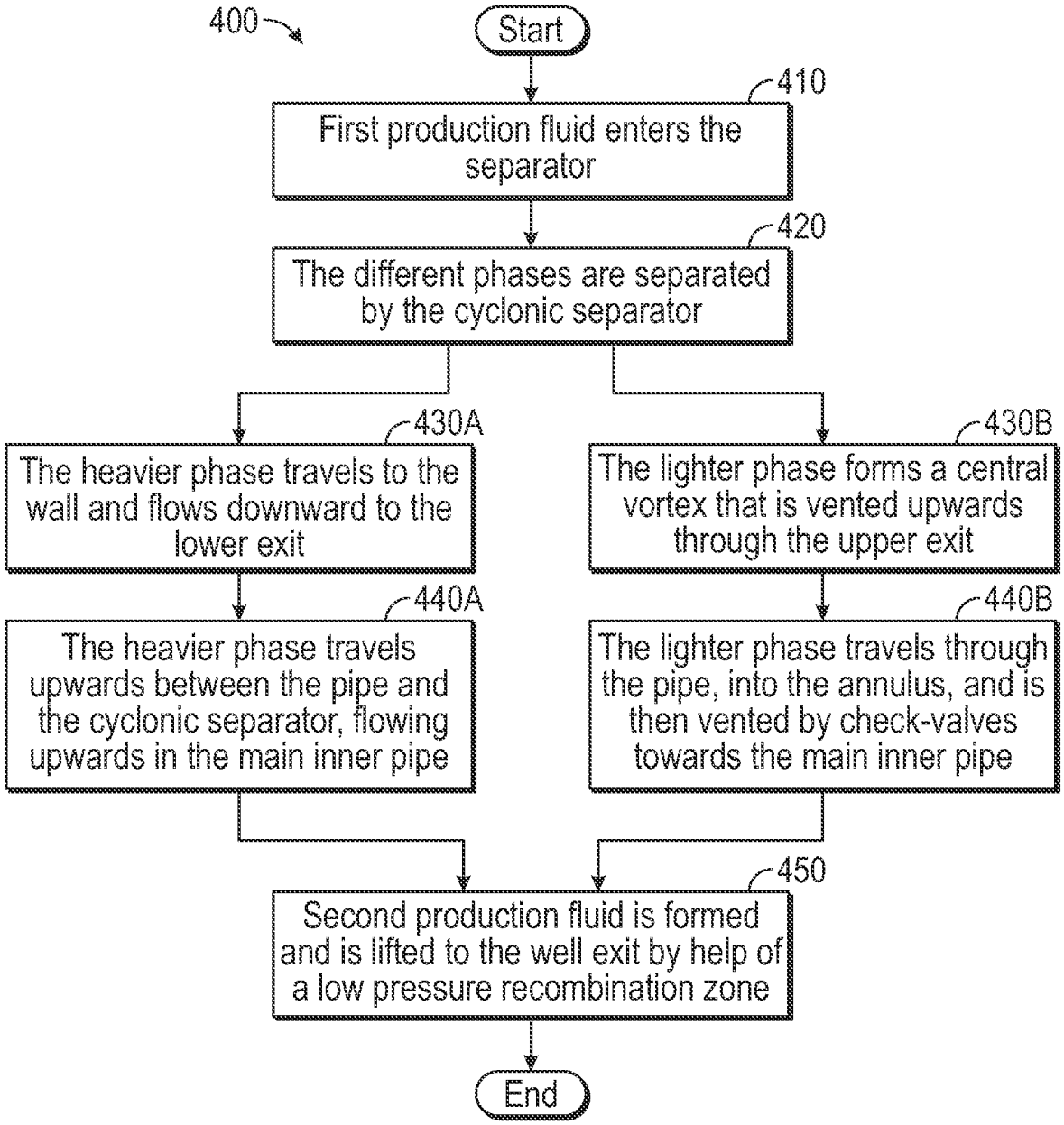
FIG. 4 shows a flowchart of a method of utilizing down-hole separation as a tool of in-situ gas-lift in accordance with one or more embodiments of the present disclosure.

FIG. 4 depicts a flowchart showing a method 400 of utilizing down-hole separation as a tool of in-situ gas-lift. While the various flowchart blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 410, a first production fluid 39 exits the annulus 21 and enters the cyclonic separator 37 disposed in the main inner pipe 27 towards the down-hole end of the wellbore 29. The first production fluid 39 may be any of fluids produced at the surface 20 such as oil, gas, or water. The first production fluid 39 is guided by the packers 51 towards the cyclonic separator 37. The packers 51 act as seals and are disposed in the annulus 21 adjacent to the cyclonic separator 37. The cyclonic separator 37 receives the first production fluid 39 through an entrance opening 49 disposed on the wall 47 of the cyclonic separator 37.

In block 420, the first production fluid 39 is separated by the cyclonic separator 37 into two different phases, a lighter phase 41 and a heavier phase 43. Typically, lighter phase 41 is a gas-rich stream and the heavier phase 43 is an oil-rich stream. The different phases are separated by centrifugal force in tandem with a central vortex 53 being formed by the first production fluid 39 in the cyclonic separator 37.

In block 430A, the heavier phase 43 travels to a wall 47 of the cyclonic separator 37 after separating from the lighter phase 41. From the wall 47, the heavier phase 43 flows downward to a second exit 61 of the cyclonic separator 37 disposed at the lower axial end of the cyclonic separator 37. The second exit 61 allows the heavier phase 43 to exit the cyclonic separator 37 and leads to the main inner pipe 27.

In block 440A, after exiting the second exit 61 of the cyclonic separator 37, the heavier phase 43 flows upwards in the main inner pipe 27 between the cyclonic separator 37 and the pipe 45 towards the low pressure recombination zone 83. The cyclonic separator 37 and pipe 45 are sealed, preventing the heavier phase 43 from entering.

In block 430B, occurring in tandem with block 430A, the lighter phase 41 is vented upwards by the central vortex 53 through a first exit 55 of the cyclonic separator 37 disposed at the upper axial end of the cyclonic separator 37. The first exit 55 is fluidly connected to the inlet 57 of the pipe 45 and allows the lighter phase 41 to exit the cyclonic separator 37.

In block 440B, occurring in tandem with block 440A, the lighter phase 41 travels from the inlet 57 of the pipe 45 through the first branch 59 of the pipe 45 and splits at the junction 67 of the pipe 45. The junction 67 of the pipe 45 fluidly interconnects the plurality of branches of the pipe 45. Then, the lighter phase 41 travels through the second branch 63 and third branch 65 of the pipe 45, and out of the pipe 45 through the first outlet 69 of the pipe 45 and the second outlet 71 of the pipe 45, respectively, into the annulus 21. Both the first outlet 69 and second outlet 71 are fluidly connected to an annulus 21.

In one embodiment, as depicted in FIG. 2, subsequent to the lighter phase 41 exiting the T-shaped embodiment of the pipe 45 and entering the annulus 21, the lighter phase 41 is directed through the openings 77 in the annulus 21 towards the main inner pipe 27. The openings 77 in the annulus 21 are configured to act as gas mandrels and allow the lighter phase 41 to exit the annulus 21 and enter the main inner pipe 27.

In an additional embodiment, as depicted in FIG. 3, subsequent to the lighter phase 41 exiting the Y-shaped embodiment of the pipe 45 and entering the annulus 21, the lighter phase 41 is vented by check valves 79, disposed at the openings 77 in the annulus 21, towards the main inner pipe 27. The check valves 79 prevent the heavier phase 43 from entering the annulus 21.

In block 450, the lighter phase 41 is reintroduced to the heavier phase 43 at a low pressure recombination zone 83 disposed in the main inner pipe 27, adjacent to the openings 77 in the annulus 21, forming a second production fluid 81. The lighter phase 41 is reintroduced to act as a gas-lifting mechanism. The lighter phase 41 lightens the fluid column by reducing the specific gravity of the fluid column as a result of the lighter phase 41 and heavier phase 43 mixing. By the help of the low pressure recombination zone 83 the second production fluid 81 is lifted towards the well exit 15 to be produced.

Accordingly, the aforementioned embodiments as disclosed relate to devices and methods useful for utilizing down-hole separation as a tool for in-situ gas-lift.

The disclosed system for and methods of utilizing down-hole separation as a tool of in-situ gas-lift advantageously revive dead wells and sustain hydrocarbon production. Additionally, the disclosed system and methods are advantageously self-powered, requiring less operational cost compared to alternative systems, such as ESPs. Also, the system and methods advantageously provide a faster route for produced gas which, in turn, acts as a gas-lift mechanism. Further, the disclosed system and methods advantageously provide an adequate gas production rate and ensure a continuous gas-lift process.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

a cyclonic separator configured to separate a first production fluid into a lighter phase and a heavier phase, the cyclonic separator comprising:

an entrance opening configured to receive the first production fluid;

a first exit disposed at an upper axial end of the cyclonic separator; and a second exit disposed at a lower axial end of the cyclonic separator;

a pipe configured to transport the lighter phase from the first exit of the cyclonic separator to an annulus, the pipe comprising:

an inlet fluidly connected to the cyclonic separator;

a first outlet fluidly connected to the annulus; and a second outlet fluidly connected to the annulus; and a low pressure recombination zone configured to reintroduce the lighter phase to the heavier phase, thereby forming a second production fluid, wherein the low pressure recombination zone is configured to transport the second production fluid to a well exit.

2. The system according to claim 1, the pipe further comprises:

a first branch connected to the inlet;

a second branch connected to the first outlet; and a third branch connected to the second outlet, wherein the first branch, the second branch, and the third branch are fluidly interconnected at a junction.

3. The system according to claim 2, the pipe further comprising:

a first angle that is between the first branch and the second branch and is between 90 and 180 degrees; and a second angle that is between the first branch and the third branch and is between 90 and 180 degrees.

4. The system according to claim 1, wherein the cyclonic separator is configured to form the lighter phase into a central vortex when the first production fluid is separated.

5. The system according to claim 1, wherein the low pressure recombination zone is disposed in a main inner pipe adjacent to an opening in the annulus.

6. The system according to claim 5, wherein the annulus further comprises a check valve disposed at the opening of the annulus, configured to allow the lighter phase to pass from the annulus to the main inner pipe.

7. A method, comprising:

receiving a first production fluid from an entrance opening of a cyclonic separator;

separating, by the cyclonic separator, the first production fluid into a lighter phase and a heavier phase;

transporting, by a pipe, the lighter phase from an inlet fluidly connected to a first exit disposed at an upper axial end of the cyclonic separator to a first outlet and a second outlet connected to an annulus;

reintroducing the lighter phase to the heavier phase in a main inner pipe subsequent to the heavier phase traveling to a wall of the cyclonic separator and exiting the cyclonic separator through a second exit disposed at a lower axial end of the cyclonic separator, thereby producing a second production fluid; and transporting, by a low pressure recombination zone, the second production fluid to a well exit.

8. The method according to claim 7, further comprising forming the lighter phase into a central vortex when the first production fluid is separated.

9. The method according to claim 8, further comprising venting the lighter phase through the first exit of the cyclonic separator subsequent to the central vortex of the lighter phase being formed.

10. The method according to claim 7, further comprising transporting the heavier phase upwards in the main inner pipe between the cyclonic separator and the pipe, subsequent to the heavier phase exiting the cyclonic separator.

11. The method according to claim 7, further comprising directing the lighter phase from the annulus, through an opening in the annulus, into the main inner pipe.

12. The method according to claim 7, further comprising venting the lighter phase from the annulus, through an opening in the annulus, into the main inner pipe by a check valve.

13. The method according to claim 12, further comprising preventing, by the check valve, the heavier phase from entering the annulus.

14. The method according to claim 7, further comprising, after separating the lighter phase and the heavier phase, mixing the lighter phase and the heavier phase at the low pressure recombination zone in the main inner pipe.

15. The method according to claim 7, further comprising producing the second production fluid in the low pressure recombination zone.

* * * * *